US009745026B1

(12) United States Patent
Cummings et al.

(10) Patent No.: US 9,745,026 B1
(45) Date of Patent: Aug. 29, 2017

(54) LADDER FOR RIGID INFLATABLE BOATS

(75) Inventors: Mason Cummings, New Smyrna, FL (US); Bryan Tudeen, Edgewater, FL (US)

(73) Assignee: Brunswick Commercial & Government Products, Inc., Edgewater, FL (US)

( * ) Notice: Subject to any disclaimer, the term of this patent is extended or adjusted under 35 U.S.C. 154(b) by 1066 days.

(21) Appl. No.: 13/408,449

(22) Filed: Feb. 29, 2012

(51) Int. Cl.
*B63B 27/14* (2006.01)

(52) U.S. Cl.
CPC ..... *B63B 27/146* (2013.01)

(58) Field of Classification Search
CPC ..... B63B 27/146; B63B 27/14
USPC ..... 182/116, 84, 206, 107, 214
See application file for complete search history.

(56) References Cited

U.S. PATENT DOCUMENTS 2,764,766 A * 10/1956 Boyle et al. ..... 441/38
D181,617 S 12/1957 Allison
3,035,286 A * 5/1962 Brill ..... 441/37
3,169,503 A 2/1965 Lane
3,195,680 A * 7/1965 Thornburg et al. ..... 182/92
3,385,399 A * 5/1968 Douglas ..... 182/70
3,498,410 A 3/1970 Storch
3,539,033 A * 11/1970 Schwarz et al. ..... 182/77
3,587,123 A * 6/1971 O'Boyle ..... 14/362
3,892,290 A * 7/1975 Lang ..... 182/22
4,186,820 A * 2/1980 Cosman ..... 182/93
4,312,536 A * 1/1982 Lloyd ..... 4/559
4,329,751 A * 5/1982 Cigognetti ..... 114/345
4,398,620 A * 8/1983 Townsend ..... 182/45
4,538,314 A * 9/1985 Baranowski ..... 14/71.1
4,541,507 A * 9/1985 Gibellato ..... 182/86
4,572,330 A * 2/1986 Langevin ..... 182/206
4,719,989 A * 1/1988 Ritten ..... 182/93
4,724,925 A * 2/1988 Ritten ..... 182/97
5,141,075 A * 8/1992 Brett ..... 182/97
D329,420 S * 9/1992 Tsuchiya ..... D12/317
5,287,945 A * 2/1994 Thurlow ..... 182/97
5,427,049 A * 6/1995 Mardikian ..... 114/362
6,401,861 B1 * 6/2002 Marszalek ..... 182/84
6,651,776 B2 * 11/2003 Montecer, Jr. ..... 182/196
6,941,889 B1 * 9/2005 McCrocklin et al. ..... 114/362
6,948,588 B1 * 9/2005 Chustak ..... 182/97
7,011,036 B1 * 3/2006 Hill ..... 114/362
(Continued)

*Primary Examiner* — Katherine Mitchell
*Assistant Examiner* — Shiref Mekhaeil
(74) *Attorney, Agent, or Firm* — Malin Haley DiMaggio & Bowen, P.A.

(57) ABSTRACT

A ladder system for a boat having gunwale tubing comprises a ladder including two side rails and at least one rung transversely disposed across the side rails and a platform having a curved recess and platform surface. The top portion of the ladder is pivotably attached to the side of the platform and extends downward therefrom. The platform is disposed on the gunwale tubing of the boat such that the curved recess of the platform receives and engages the tubing. A stanchion extends laterally from the ladder and includes two support each extending from a corresponding side rail of the ladder. A stanchion pad is disposed at an end of said stanchion disposed between the two stanchion supports, and engages the hull of the boat to prevent twisting of the ladder when it is deployed. The ladder system prevents deformation of the gunwale tubing while providing enhanced stability.

12 Claims, 4 Drawing Sheets

(56) References Cited

U.S. PATENT DOCUMENTS

| | | | | |
|---|---|---|---|---|
| 7,051,497 | B2 * | 5/2006 | Peterson et al. | 54/44.1 |
| 7,861,663 | B2 * | 1/2011 | Sedlack, II | 114/362 |
| 8,074,768 | B2 * | 12/2011 | Rund | 182/86 |
| 8,074,771 | B2 * | 12/2011 | Nickelson | 182/195 |
| 8,157,053 | B1 * | 4/2012 | Lameiro | 182/36 |
| 2005/0126855 | A1 * | 6/2005 | Tilley | 182/107 |
| 2011/0132252 | A1 * | 6/2011 | Kaye | 114/362 |

* cited by examiner

LADDER FOR RIGID INFLATABLE BOATS

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

The present invention generally relates to marine vessels and components related thereto and more specifically to a dive and/or boarding ladder for a rigid inflatable boat.

2. Description of Related Art

Rigid-hulled inflatable boats, also known as rigid inflatable boats (RIB) are popular sea-faring vessels that are stable, seaworthy, and versatile. RIBs are useful in recreational, commercial, and military applications. A typical RIB comprises a solid, traditionally v-shaped hull having flexible inflatable tubes disposed around the gunwale (i.e. top edge of the side) thereof. RIBs are designed to be hydroplaning boats and can be powered by an outboard motor or an inboard water-jet motor. The hull of the RIB may be comprised of wood, steel, aluminum, fiberglass, glass-reinforced plastic, or combinations thereof. The inflatable gunwale tubing is often comprised of a resilient rubber or plastic composite such as, for example, hypalon, polyvinyl chloride or polyurethane. Many RIBs can outperform traditional fiberglass boats and often are more difficult to sink and provide improved ride and handling in heavy seas. Additionally, the relatively flexible and durable gunwale tubing provides protection for the RIB and other vessels and structures it may come in contact with.

As noted, RIBs are quite versatile and can be used as rescue craft, patrol vessels, dive boats, or tenders for larger boats. With respect to rescue and dive use, access between the vessel and the water is typically provided over the gunwale of the RIB because the tight geometry, narrow transom, and overall configuration of the vessel do not provide adequate space for a dive ladder or other boarding means. Although boarding/de-boarding over the gunwale is not difficult for an able-bodied individual, it is not ideal when dealing with an injured individual who may be strapped to a stretcher or other rescue device. Over-the-gunwale boarding/de-boarding is likewise not ideal for a rescuer/diver that may be carrying several pounds of cumbersome equipment.

Several attempts at providing a ladder or other boarding device for sea-faring vessels have been made. For example, U.S. Patent Application Publication No. 2011/0132252 to Kaye describes a removable casting deck assembly for a rigid inflatable boat includes a deployable swim ladder which is stored in a top deck panel, and is rotated through a hinge assembly to a position enabling use. The deck assembly includes curved stabilizers where are disposed around the curvature of the inflatable tubing along the gunwale of the vessel.

U.S. Pat. No. 7,861,663 to Sedlack provides a portable boarding ladder for inflatable watercraft, which is attached to a pontoon or side wall tube of the boat. The ladder is attached to a rubberized portion of an inflatable boat without the use of piercing fasteners and does not require a hard point mounting structure. A base ladder section and a climbing ladder section are pivotally coupled together and supported in an operative, stand-off boarding position along a curved hull surface of a pontoon boat by a pair of hook support brackets and a pair of latch retainer brackets. The support brackets are bonded to the pontoon by adhesive deposits. A lateral cross bar tubing segment of the base ladder section is supported by hanging engagement on the hook brackets. A pair of side rail tubing segments of the climbing ladder section are retained and secured against lateral shifting displacement and rotation relative to the pontoon by snap-fit engagement against resilient arm portions of the latch retainer brackets.

U.S. Pat. No. 5,541,507 'to Gibellato illustrates a universal folding ladder for inflatable boats, having an L-shaped upper section which is supported by the gunwale of the boat and one or more ladder sections pivotably attached to the bottom of the upper section and extending into the water to provide a stand-off boarding position. The upper section includes a plurality of slats or boards providing a standing deck surface at the top of the inflatable tubing/gunwale.

U.S. Pat. No. 4,186,820 to Cosman provides a boarding ladder for use on an inflatable boat. The system includes a strap assembly placed around the inflatable tubing which is adapted to mount a rigid ladder to the boat. The rigid ladder portion has a pair of struts extending from the ladder toward the board. The struts cooperate with a horizon cross-piece at the top of the ladder to mount the ladder in an orientation extending downward and outward from the side of the board, and prevent the ladder from rotating under the boat when in use.

U.S. Pat. No. 3,498,410 to Storch provides a vessel ladder hingeably mounted to the gunwale of a traditional vessel wherein the ladder includes a stand-off rod transversely disposed between the ladder and the side of the vessel to provide support and proper attitude of the ladder when in use.

Although the prior art provides some useful boarding ladder designs for inflatable vessels, none extend far enough into the water and most cause the gunwale tubing to deform or deflect outwardly. Additionally, none provide a sufficiently sturdy and useful platform for entry and exit. Indeed, the prior art relies on the inflatable tubing to provide vertical support at the top of the ladder, which causes a reduction in ladder stability and leads to unwanted deformation of the tubing during use. Consequently, there is a need in the art for a dive/boarding ladder useful for inflatable vessels that provides a useful upper platform, an extended-length ladder portion, and overall stable and sturdy design that resists rotation and/or twisting of the ladder and deformation of the vessels inflatable gunwale tubing.

It is, therefore, to the effective resolution of the aforementioned problems and shortcomings of the prior art that the present invention is directed. However, in view of the dive/boarding ladders in existence at the time of the present invention, it was not obvious to those persons of ordinary skill in the pertinent art as to how the identified needs could be fulfilled in an advantageous manner.

SUMMARY OF THE INVENTION

The present invention provides a ladder system for a boat, such as a rigid-hull inflatable boat having a hull and gunwale tubing. The ladder system comprises a ladder including two side rails and at least one rung transversely disposed across the side rails and a platform having a curved recess and platform surface. The top portion of the ladder is attached to the side of the platform and extends downward therefrom. The platform is disposed on the gunwale tubing of the boat such that the curved recess of the platform receives and engages at least a top portion of the tubing. In some embodiments, the top portion of the ladder is pivotably attached to the side of the platform such that the ladder can be rotated upward and downward, providing at least two operative positions, a deployed position, and a storage position. In some embodiments, the ladder system includes a stanchion extending laterally from the ladder. The stanchion comprises two support each extending from a corresponding side rail of the ladder. A stanchion pad is disposed at an end of said stanchion disposed between the two stanchion supports, and is adapted to engage the hull of the boat to prevent twisting of the ladder when it is deployed. In some embodiments, the stanchion is pivotably attached to the side rails of the ladder such that the stanchion can be collapsed toward the ladder for storage.

Accordingly, it is an object of the present invention to provide a ladder system suitable for inflatable boats that prevents deformation or damage to the gunwale tubing during use.

It is another objection of the present invention to provide a ladder system suitable for inflatable boats that provides a stable platform for boarding/deboarding the boat over the gunwale tubing.

It is yet another object of the present invention to provide a ladder system suitable for inflatable boats that is capable of collapsing for storage.

It is yet another object of the present invention to provide a ladder system suitable for inflatable boats that includes a stanchion extending laterally from the ladder and comes in contact with the hull of the boat in order to prevent unwanted twisting or rotation of the ladder during use.

In accordance with these and other objects which will become apparent hereinafter, the instant invention will now be described with particular reference to the accompanying drawings.

DETAILED DESCRIPTION

Figure 1:
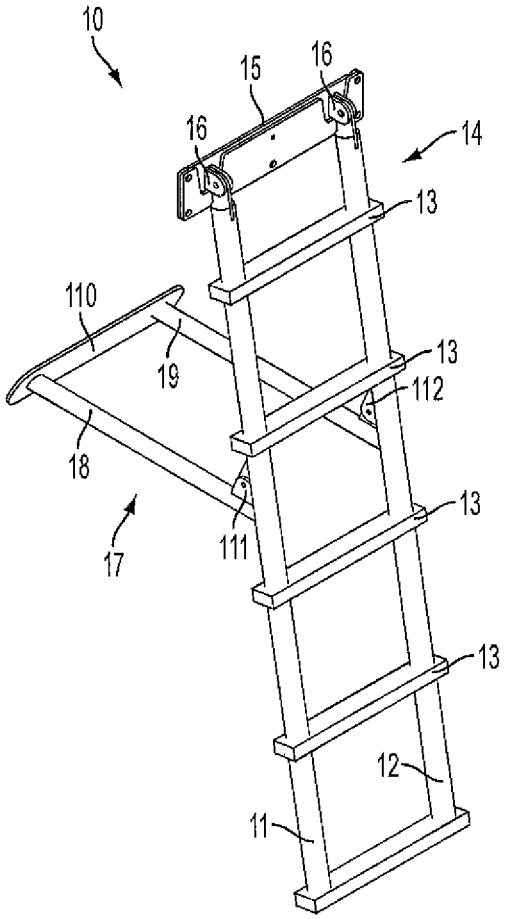
FIG. 1 is a perspective view of the ladder of the present invention in isolation.

With reference to FIG. 1, shown is the ladder 10 of the present invention isolated from a vessel or any other structure. Ladder 10 comprises two side rails 11 and 12 in parallel configuration having at least one ladder rung 13 transversely disposed across the side rails. In some embodiments, a plurality of ladder rungs 13 is provided. In some embodiments, side rails 11 and 12 are generally tubular and are configured to extend downward into the water when ladder 10 is in its deployed position. The top portion 14 of ladder 10 is pivotably mounted to attachment bracket 15. Accordingly, in some embodiments, the top of each side rail 11 and 12 includes a thinned protrusion which engages a bi-furcated attachment tongue 16. In this manner, the entirety of ladder 10 can pivot about tongues 16 and, in some embodiments, pivots upward for storage.

Attached to and extending laterally from side rails 11 and 12 is a stanchion 17. Stanchion 17 comprises two supports 18 and 19 attached at a first end to side rails 11 and 12, respectively. A stanchion pad 110 is disposed transversely across a second end of each of the supports 18 and 19. In some embodiments, supports 18 and 19 are pivotably attached to side rails 11 and 12, respectively, such that stanchion 17 can pivot and rotate upwards toward side rails 11 and 12. In some embodiments, supports 18 and 19 are attached to attachment tongues 111 and 112 on side rails 11 and 12, respectively. This allows the stanchions to collapse, reducing the footprint of the ladder 10 for storage. As shown, in some cases the stanchion 17 is attached to side rails 11 and 12 substantially toward the mid point thereof. It is appreciated, however, that the location of the stanchion 17 relative to the side rails 11 and 12 can vary depending on the desired application, taking into account the configuration of the vessel to with which the ladder 10 is used.

Figure 2:
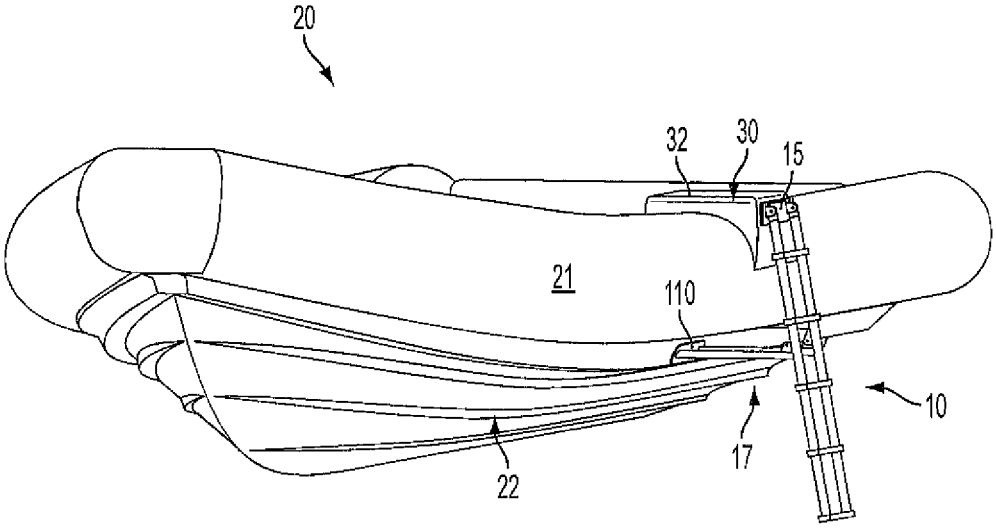
FIG. 2 is a perspective view of the ladder of the present invention attached to a rigid-hulled inflatable boat.
Figure 3:
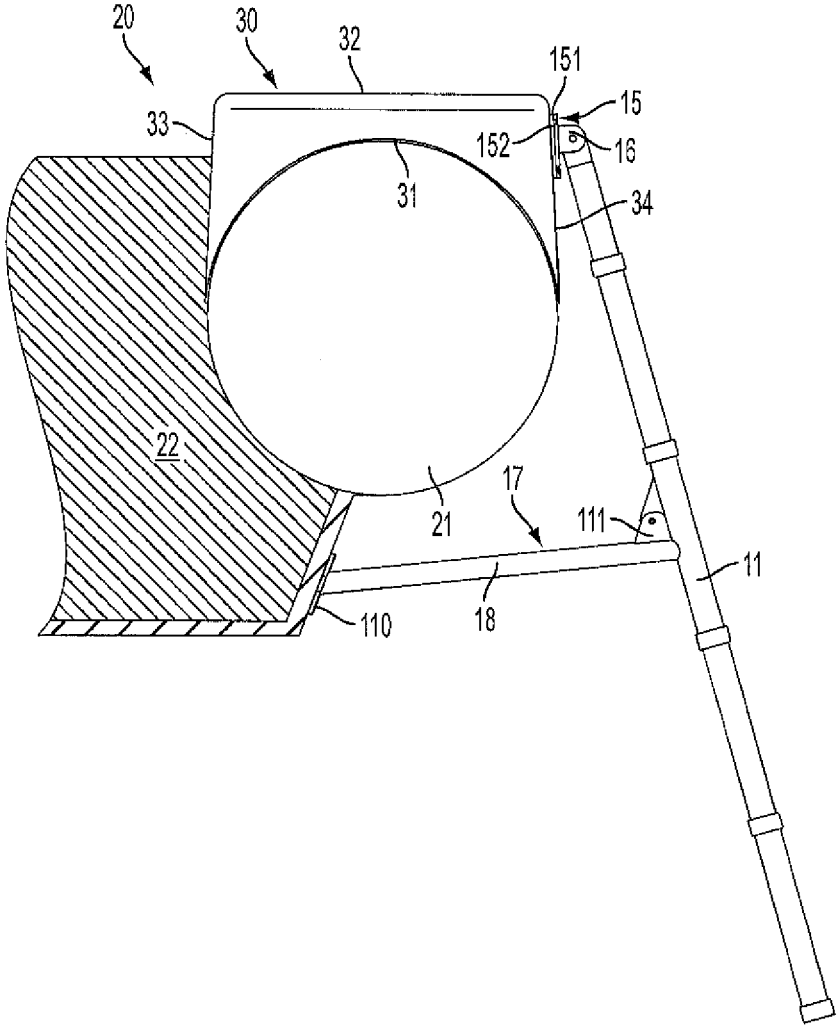
FIG. 3 is a side cross-sectional view of the ladder of the present invention attached to gunwale tubing of a rigid-hulled inflatable boat.

With reference to FIG. 2, shown is a perspective view of ladder 10 in its fully deployed position, attached to a boat 20 which is depicted as a rigid-hulled inflatable boat. Boat 20 includes gunwale tubing 21 disposed on top of and around the perimeter of hull 22. Ladder 10 is mounted to the side of boarding platform 30. The platform 30 has a curved recess 31 (FIG. 3) which receives and conforms to the curvature of the top of gunwale tubing 21. Bracket 15 is secured to the side of platform 30 by known means, such as bolts, screws, rivets, or the like. With reference to FIG. 3, a first side 151 of the bracket 15 attached to the top portion 14 of ladder 10 and a second side 152 is secured to the side of platform 30. Ladder 30 extends downward from platform 30 at least partially into the water (not shown). Stanchion 17 extends inward from ladder 10 toward hull 22 such that stanchion pad 110 is pressed against hull 22. Accordingly, stanchion 17 prevents twisting and rotation of ladder 10 while deployed, providing a significant advantage over the prior art.

FIG. 3 more clearly shows the present invention deployed on Boat 20, from a cross-sectional perspective. As shown, the curved recess 31 is received over gunwale tubing 21 and provides a substantially planar platform surface 32 extending above the gunwale tubing 21. The two side walls 33 and 34 of platform 30 extend downward around tubing 21, providing stability and resistance to rotation. Platform 30 is configured to provide a stable platform for accessing ladder 10 that does not cause deformation or damage to the gunwale tubing 21. To wit, platform 30 evenly distributes the forces applied to the ladder 10 across the gunwale tubing in radial fashion, which limits deformation of the gunwale tubing and greatly enhances stability and usability as compared to prior designs. Accordingly, platform 30 provides a stable working surface for recreational, commercial, and rescue use.

Figure 4:
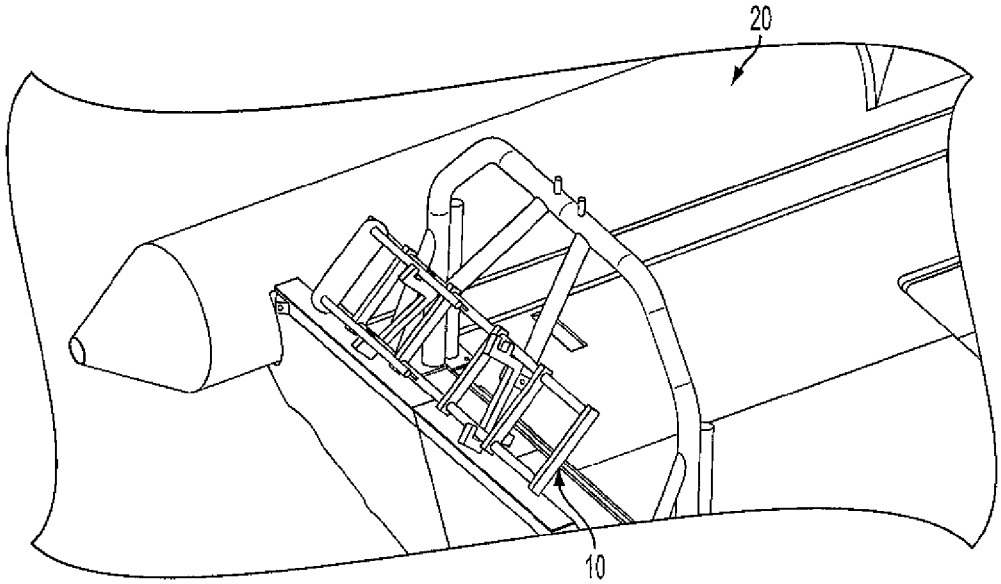
FIG. 4 is a perspective view of the rear of a rigid-hulled inflatable boat, showing the ladder of the present invention in a stowed position.

The ladder 10 of the present invention is configured to collapse and be removed for storage. Accordingly, ladder 10 provides at least two operable positions, a deployed position and a storage position. In the storage position, stanchion 17 is rotated inward about tongues 111 and 112 against side rails 11 and 12. Platform 30 can then be removed from the top of gunwale tubing 21, and the entire ladder 10 can be removed for storage. FIG. 4 depicts the entire assembly of ladder 10 stored at the rear of boat 20. In the deployed position, platform 30 is situated over the top of gunwale tubing 21 and stanchion 17 is rotated outward about tongues 111 and 112 and ladder 10 is pivoted about tongues 16 such that ladder 10 rotates downward and extends into the water. To provide the most stability, ladder 10 is pivoted downward until stanchion pad 110 comes into contact with hull 22. Accordingly, the pivoting engagement of the ladder 10 with platform 30 allows the ladder 10 be adjusted in order to provide optimum stability while deployed. While the depicted embodiments utilize tongues 16, 111, and 112 to allow for the respective components to pivot and rotation, other known structures allowing such pivoting are equally suitable. In some embodiments, the platform 30 is not permanently affixed to gunwale tubing, but rather the entire ladder 10 can be removed from the gunwale tubing and stored elsewhere on the vessel (FIG. 4), or on dry dock.

It is appreciated that the size of the ladder 10 and the other components of the present invention can vary without departing from the present invention. For example, if ladder 10 is to be used on a vessel's which has gunwale tubing that extends further outward from the hull surface, then a long stanchion 17 may be provided. Further, platform 30 and recess 31 can be altered in size and shape to accommodate a variety of differently sized and shaped gunwale tubing. Further still, the overall length of ladder 10 and specifically rails 11 and 12 can be altered as desired. For example, a dive ladder may be desired to be longer than a rescue ladder.

Based on the foregoing, it is apparent the present invention provides substantial advantages compared to existing RIB ladders. The integration of the platform 30 with the ladder 10 improves load handling and prevents deformation or damage to the gunwale tubing 22. Further, the stanchion 17 which comes in contact with hull 22 ensures that the ladder 10 will not twist or rotate while in use, particularly in rougher sea conditions. Accordingly, the present invention provides greatly enhanced safety, usability, durability, and functionality. It is further appreciated that the present invention, while suitable for rigid-hulled inflatable boats, could be equally useful on other types of vessels, including standard fiberglass-hulled boats, soft-hulled inflatable boats, and the like.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A ladder system for a boat having a hull and gunwale tubing, comprising:

a ladder including two side rails and at least one rung transversely disposed across said side rails;

a platform having a curved recess and a substantially planar platform surface;

said ladder attached to a side of said platform; and wherein said platform is configured to be disposed on said gunwale tubing such that said curved recess receives a top portion of said gunwale tubing with said substantially planar platform surface extending above said gunwale tubing.

2. The ladder system of claim 1, further comprising a stanchion extending laterally from said ladder.

3. The ladder system of claim 2, wherein a stanchion pad is disposed at an end of said stanchion, said pad adapted to engage said hull of said boat to prevent twisting of said ladder.

4. The ladder system of claim 3, wherein said stanchion comprises two support members extending laterally from said side rails, wherein said stanchion pad is disposed transversely across said support members.

5. The ladder system of claim 4, wherein said support members are pivotably attached to said side rails.

6. The ladder system of claim 1, further comprising an attachment bracket having a first side and an opposing second side, said side rails of said ladder pivotably attached to said first side of said attachment bracket and said second side of said attachment bracket secured to said side of said platform of said ladder.

7. A ladder system for a boat having a hull and gunwale tubing, comprising:

a ladder including two side rails and at least one rung transversely disposed across said side rails;

a stanchion including a stanchion pad;

a platform having a curved recess and a substantially planar platform surface;

said ladder pivotably attached to a side of said platform;

said stanchion attached to and extending laterally from said ladder;

wherein said platform is configured to be disposed on said gunwale tubing such that said curved recess receives a top portion of said gunwale tubing with said substantially planar platform surface extending above said gunwale tubing; and wherein said stanchion pad is adapted to engage said hull of said boat to prevent twisting of said ladder.

8. The ladder system of claim 7, wherein said stanchion comprises two support members extending laterally from said side rails, wherein said stanchion pad is disposed transversely across said support members.

9. The ladder system of claim 8, wherein said support members are pivotably attached to said side rails of said ladder.

10. A ladder system for a boat having a hull and gunwale tubing, comprising:

a ladder including two side rails and at least one rung transversely disposed across said side rails;

a stanchion including a stanchion pad;

a platform having a curved recess and a substantially planar platform surface;

said ladder pivotably attached to a side of said platform;

said stanchion pivotably attached to and extending laterally from said ladder;

wherein said platform is disposed on said gunwale tubing such that said curved recess receives a top portion of said gunwale tubing with said substantially planar platform surface extending above said gunwale tubing;

wherein said stanchion pad is adapted to engage said hull of said boat to prevent twisting of said ladder;

wherein said ladder system provides at least a deployed position.

11. The ladder system of claim 10, wherein said stanchion comprises two support members extending laterally from said side rails, wherein said stanchion pad is disposed transversely across said support members.

12. The ladder system of claim 11, wherein said support members are pivotably attached to said side rails of said ladder.

* * * * *